US005964390A

United States Patent [19]

Børresen et al.

[11] Patent Number: 5,964,390

[45] **Date of Patent: *Oct. 12, 1999**

[54] ARRANGEMENT AND WEB TENSION CONTROL UNIT FOR WEB DELIVERY

[75] Inventors: Harald E Børresen, Stokke; Terje Nyren, Sandefjord, both of Norway

[73] Assignee: SCA Hygiene Products AB, Gothenburg, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,720

[22] PCT Filed: Nov. 21, 1995

[86] PCT No.: PCT/SE95/01380

§ 371 Date: May 22, 1997

§ 102(e) Date: May 22, 1997

[87] PCT Pub. No.: WO96/15968

PCT Pub. Date: May 30, 1996

[30] Foreign Application Priority Data

Nov. 23, 1994 [SE] Sweden ..... 9404067

[51] Int. Cl.[6] ..... B65H 26/00; B65H 20/24; B65H 20/32; B65H 59/18

[52] U.S. Cl. ..... 226/44; 226/118.2; 242/417.3; 242/418.1

[58] Field of Search ..... 226/24, 44, 118.2, 226/42; 242/417.3, 418.1, 615, 615.4

[56] References Cited

U.S. PATENT DOCUMENTS

| | | | |
|---|---|---|---|
| 2,229,480 | 1/1941 | Spencer et al. | 242/417.3 X |
| 2,696,192 | 12/1954 | Birchler et al. | 242/417.3 X |
| 3,294,301 | 12/1966 | Richter | 226/44 X |
| 3,366,147 | 1/1968 | Picanol | 242/417.3 X |
| 3,463,413 | 8/1969 | Smith | 242/417.3 X |
| 3,567,148 | 3/1971 | Ottavan | 242/417.3 X |
| 3,587,959 | 6/1971 | Glover | 226/44 X |
| 3,724,733 | 4/1973 | Schaffer et al. . | |
| 3,912,145 | 10/1975 | Meihofer | 226/44 |
| 3,963,191 | 6/1976 | Goodley | 242/417.3 |
| 4,035,878 | 7/1977 | Cheatham | 242/615.4 |
| 5,472,127 | 12/1995 | Ichii et al. | 226/44 |
| 5,480,085 | 1/1996 | Smithe et al. | 226/44 |

FOREIGN PATENT DOCUMENTS

| | | |
|---|---|---|
| 2185464 | 7/1987 | United Kingdom . |
| 2204305 | 11/1988 | United Kingdom . |

*Primary Examiner*—Michael R. Mansen
*Attorney, Agent, or Firm*—Burns, Doane, Swecker & Mathis, L.L.P.

[57] ABSTRACT

An arrangement for delivering a web of material from a storage reel to a process line for manufacturing absorbent disposable articles. The arrangement includes a web tension control unit for holding a predetermined value of tension in the web of material passing through the control unit for delivery to the process line. The control unit is placed in immediate proximity to the process line.

14 Claims, 2 Drawing Sheets

ARRANGEMENT AND WEB TENSION CONTROL UNIT FOR WEB DELIVERY

FIELD OF THE INVENTION

The present invention relates to an arrangement for delivering a web of material from a storage reel to a process line, and also to a unit included in the arrangement.

BACKGROUND OF THE INVENTION

In the manufacture of absorbent disposable articles, such as diapers, sanitary napkins and incontinence guards, a continuous web of material is conveyed through a process line, this material being either plastic film or nonwoven material. Various operations are performed in the process line, such as the placing of one or more absorbent cores on the web, the application of elastic, the application of an outer casing sheet, etc. Individual articles are separated from the continuous web of article blanks in a terminal stage of the process. In order for this process to proceed smoothly without interruptions, it is very important that the tension in the delivered web is constant at its point of delivery.

The web delivered to the process line is taken from storage reels, which are carried in pairs by a reel stand which includes means for splicing the tailing end of the web on one reel with the leading end of the web on the other reel, so that web material will be delivered continuously to the process line. These reel stands are often provided with units which are intended to ensure that the tension in the web leaving the reel stand is constant, even during the process of splicing together the webs of the old and the new reels while accelerating the new reel. It has been found that even though the tension in the web leaving the reel stand has a predetermined value, the web tension will vary at the point of its delivery to the process line, particularly when the reel stand is located at some distance from the delivery point, this variation being due to the inertia of the supporting rollers which guide the web in the space between reel stand and process line.

SUMMARY OF THE INVENTION

The object of the present invention is to provide means whereby the tension in the web will have a predetermined value at the point of its delivery to the process line, while enabling the reel stand carrying the web to be located far away from this point.

This object is achieved with an arrangement of the kind defined in the introduction which is characterized by a web tension control unit which is placed at a distance from the storage reel and in the immediate proximity of the process line. This enables the reel stand to be located in a place which will facilitate service and reel exchanges, without needing to the distance between the stand and the process line into consideration.

According to one preferred embodiment of the invention, the unit includes a distributing roller, which ensures that the web delivered to the process line will not contain wrinkles, pleats or folds.

The invention also relates to a unit for controlling the tension in an outgoing web which passes through the unit, this unit including a spring-tensioned or spring-biassed dancing or jockey arm which is pivotal about a fixed axle and which is intended to support a loop in the web, said unit being characterized in that the spring-biassing force acts in a direction opposite to the force of gravity. This arrangement enables the changes that occur in the torque acting on the dancing arm as the dancing arm rotates to be balanced by suitable geometry, so that web tension will be essentially unaffected by the rotational position of the dancing arm.

According to one advantageous embodiment of the invention, the unit includes a position indicator which senses the rotational position of the arm and delivers a position signal corresponding to this position, a pair of feeder rolls which are mounted at the upstream end of the unit and through which the web passes when the unit is operating, and a control means which receives the position signal from the position indicator and adjusts the rotational speed of the pair of feed rolls in accordance with this signal. A distributing roll is mounted downstream of the pair of feed rolls and upstream of said means and functions to form the loop supported by the dancing arm. The biassing forced is generated by a pull spring whose one end is pivotally attached to a lever arm which projects out from the dancing arm at the end thereof connected to the pivot axle, and whose other end is connected to an attachment means which can preferably be moved along a sloping path so as to enable the position of the attachment to be changed in relation to the dancing arm pivot axle, both laterally and vertically, as the attachment moves.

BRIEF DESCRIPTION OF THE DRAWINGS

The invention will now be described with reference to the accompanying drawings, in which.

DETAILED DESCRIPTION OF THE PREFERRED EMBODIMENTS

Figure 1:
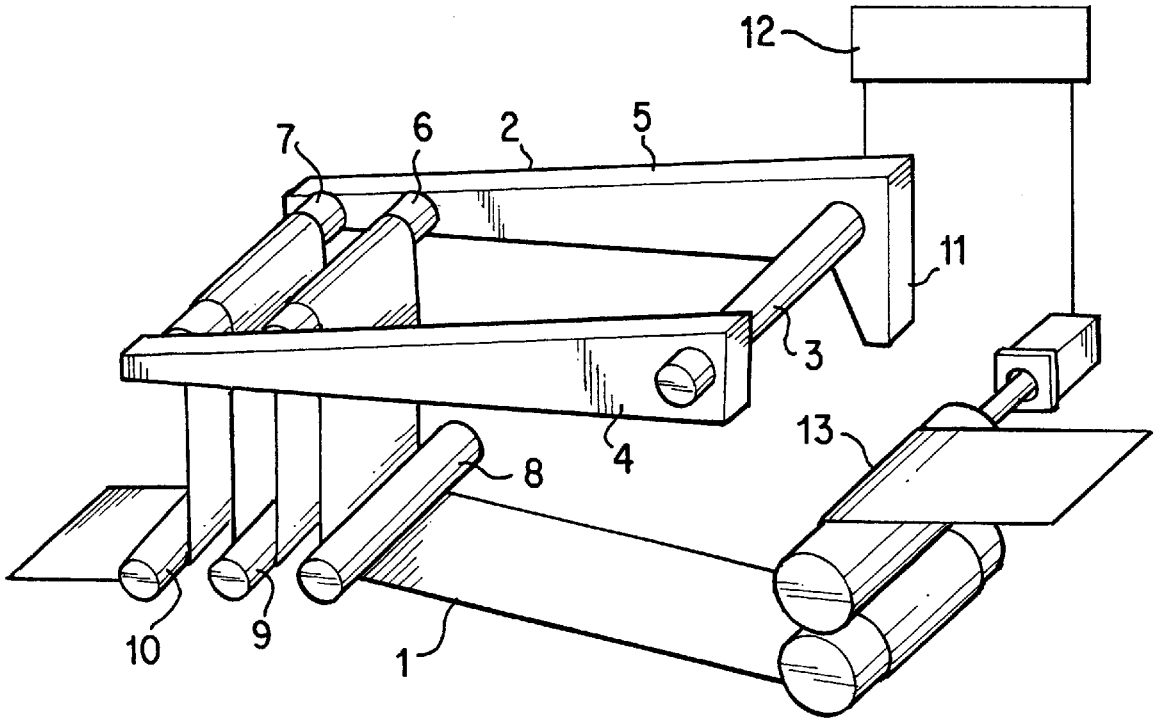
FIG. 1 illustrates schematically and in perspective the most significant components of a unit for controlling or adjusting the tension in an outgoing web of material, in accordance with the invention.

The unit for controlling or adjusting the tension of a web 1 outgoing from the unit and illustrated schematically in FIG. 1 includes a dancing arm 2 which is pivotal about an axle 3 provided on the right-hand end of the arm in FIG. 1. The arm is comprised of two parallel elongated beams 4, 5 whose right-hand ends are held together by the pivot axle 3 and whose left-hand end-parts are held together by two elongated rollers 6, 7, which are mutually spaced apart in the longitudinal direction of the arm. The pivot axle 3 and the rollers 6, 7 extend perpendicular to the beams 4, 5.

Mounted beneath the arm 2 are three elongated rollers 8, 9, 10 which are mutually spaced apart in the horizontal direction and which are also displaced horizontally in relation to the rollers 6, 7 carried by the dancing arm when said arm is pivoted to a generally horizontal position. The pivot axle 3 and the rollers 8–10 are carried by a fixed stand or housing. The pivot axle 3 is rotatably mounted in the stand and an advantage is gained when the rollers 6, 7 and 8–10 are also rotatably journalled to the dancing arm and the stand respectively to reduce the friction between the web 1 and its associated rollers, although this is not necessary.

The dancing arm 2 is provided with a spring which is not shown in FIG. 1 and which when acted upon by a downwardly projecting end-part 11 of the dancing arm strives to pivot the arm upwards in FIG. 1. The unit also includes a position indicator, for instance an angle sensor which senses the rotational position of the dancing arm and mends a signal corresponding to this position to a control means 12, which adjusts the speed at which the web is advanced by a pair 13 of web feed rollers mounted at the inlet end of the unit. The web 1 arriving at the unit will first pass through the nip between the feed rolls and will than pass beneath the roller 8, over the roller 6, beneath the roller 9, over the roller 7 and beneath the roller 10, whereafter it leaves the unit.

Web tension is determined by the pretension in the dancing arm 2 and any changes in the length of that part of the web which moves through the unit are taken-up by pivoting the dancing arm upwards or downwards, depending on whether the web has been lengthened or shortened. Such length changes may be due to differences in the speed between the part of that part of the web that leaves the unit and that part of the web which runs through the roll pair 13. These differences in web speed can easily occur when starting-up the process line, at which stage the part of the web leaving the unit is delivered to an accelerating conveyor. The changes in the length of the web moving through the unit may also be due to variations in the tension of that part of the web which arrives at the roll pair 13. As will readily be understood, when the tension in the web passing through the nip defined by the roll pair 13 is lower than the pretension or spring bias in the dancing arm that part of the web which moves through the unit will be lengthened in relation to a corresponding part of the web located upstream of the roll pair 13, the extent to which the web part is lengthened being dependent on the elasticity of the web.

The control means 12 may be any suitable control means, for instance a microprocessor, which is programmed to control the web feeding speed of the roll pair 13, such that the dancing arm will be rotated or pivoted as little as possible from a starting position, e.g. the horizontal position shown in FIG. 1. If the web is lengthened for some reason or other and the dancing arm 2 is thereby swung upwards, the earlier mentioned position indicator will send to the control means 12 a signal which corresponds to this pivotal movement of the arm 2. Upon receipt of the signal, the control means 12 causes the roll pair 13 to rotate at a slower speed. Provided that the web is drawn away from the unit at a constant speed, the length of that part of the web which runs through the unit will decrease and the dancing arm will be swung back to its starting position. If the dancing arm is instead swung downwards from its starting position, the control means 12 will cause the roll pair 13 to rotate at a higher speed. This arrangement enables the speed at which that part of the web leaving the unit is pulled away to be varied to a large extent without varying the tension in said web part and without requiring the dancing arm to perform large pivotal movements, which provides the advantage of enabling the unit to be given a relatively compact construction, among other things.

Figure 2:
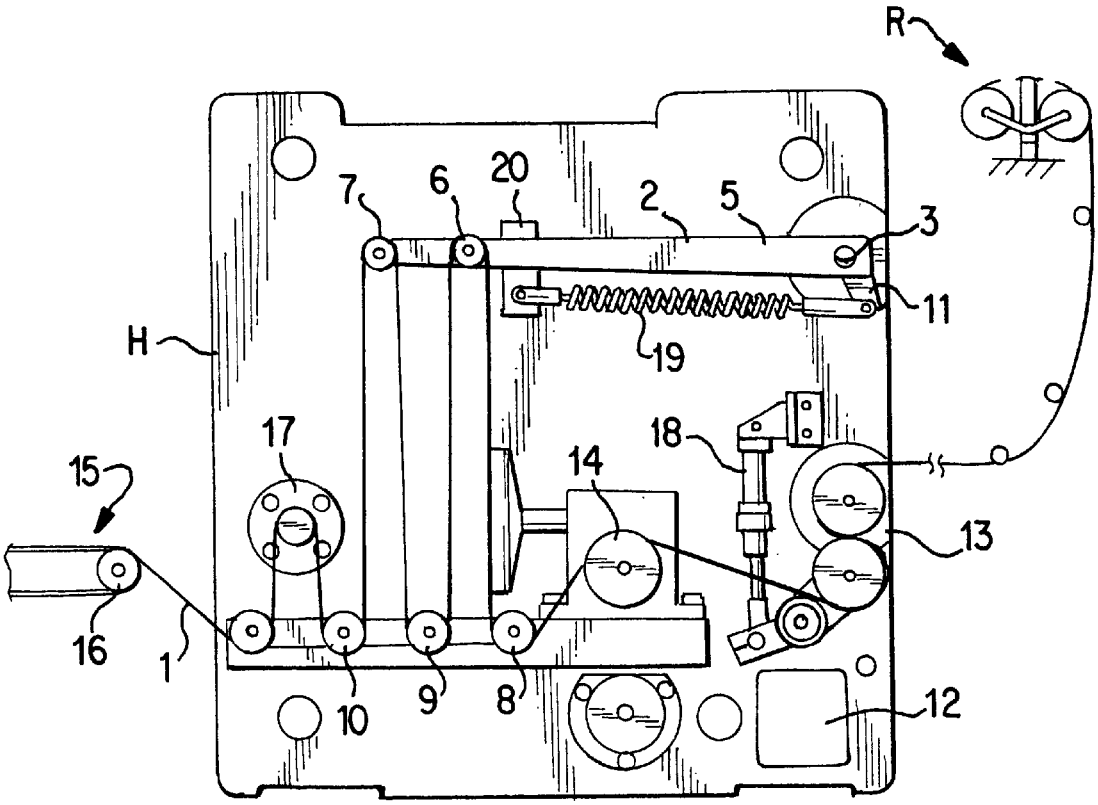
FIG. 2 is a schematic front view of a unit for controlling or adjusting the tension of an outgoing web of material in accordance with a first embodiment of the invention, the front part of the unit being removed.

FIG. 2 illustrates a first embodiment of a unit which is principly of the same construction as the unit described with reference to FIG. 1. Components of the FIG. 2 embodiment which are identical to the components of the FIG. 1 embodiment have been identified by the same references. The unit is shown in front view in the Figure, with the front of the housing H which carries the unit components being removed. In addition to the components 1–13 described with reference to FIG. 3, the unit illustrated in FIG. 2 includes a spreader or smoothing roll 14 of known construction which functions to remove any folds or wrinkles that may be present in the web 1. FIG. 2 also shows a suction conveyor 15 which is included in the process line and which has a driven wheel 16 on which that part of the web 1 leaving the unit is taken-up. Also shown in FIG. 2 is a tension measuring wheel 17 which may be of any appropriate kind and which measures the tension in the web 1, this measuring wheel being mounted in the housing if so desired, and also a mechanism 18 which parts the rolls of the roll pair 13 so as to facilitate insertion of the leading end of the web 1 through the roll pair prior to starting-up the process line. A similar mechanism may be provided for the roll pair 13. FIG. 2 also shows schematically a reel stand R from which the web 1 is unwound.

Also shown in FIG. 2 is the pull spring 19 which pretensions or spring biases the dancing arm 2. One end of the spring is connected pivotally to the downwardly projecting part 11 of the arm and the other end of the spring is pivotally connected to an attachment means 20 mounted on the housing H.

When the dancing arm 2 of the FIG. 2 embodiment is considered from its point of static equilibrium, it will be seen that the torque that acts clockwise around the pivot axle 3 through which the spring 19 acts on the dancing arm will be equal to the torque that acts anti-clockwise around the axle 3, due to the weight of the dancing arm and to the tension in the web 1 running around the rollers 6 and 7. All three torques, or moments of force, are changed when the dancing arm is pivoted, which, of course, presents a problem when desiring to maintain the web tension at a constant level irrespective of the position to which the arm is pivoted. This problem is alleviated by the described unit by virtue of the fact that the rotational speed of the feed roll pair 13 is controlled by the control means 12 so as to counteract the pivotal movements of the dancing arm, as earlier described. It will be understood that the variation in the aforesaid anti-clockwise torque as the dancing arm is pivoted cannot be influenced qualitatively to any great extent. On the other hand, the variations in the clockwise torque, which is equal to the force exerted by the spring 19 multiplied by the perpendicular distance between the pivot axle 3 and the direction in which the spring force acts, is influenced by appropriate selection of the position of the spring attachment points. It has been found that the torque that is directed clockwise by the spring force can be caused to balance the aforesaid anti-clockwise torque so that variation in web tension depending on the rotary position of the dancing arm will be almost zero, meaning that the web tension in that part of the web 1 that passes through the unit is constant and independent of the position to which the arm has been rotated. In this regard, it has been found suitable to position the attachment points so that when in its starting position the spring will be generally parallel with the dancing arm and so that the angle defined by the longitudinal axis of the dancing arm and a line which passe a through the spring attachment point on the piece that projects down from the dancing arm and the rotational axis of the dancing arm is somewhat greater than 90°, and so that the distance between the rotational axis of the dancing arm and the spring attachment point on said arm will be relatively small, about 10% or the length of the arm.

Figure 3:
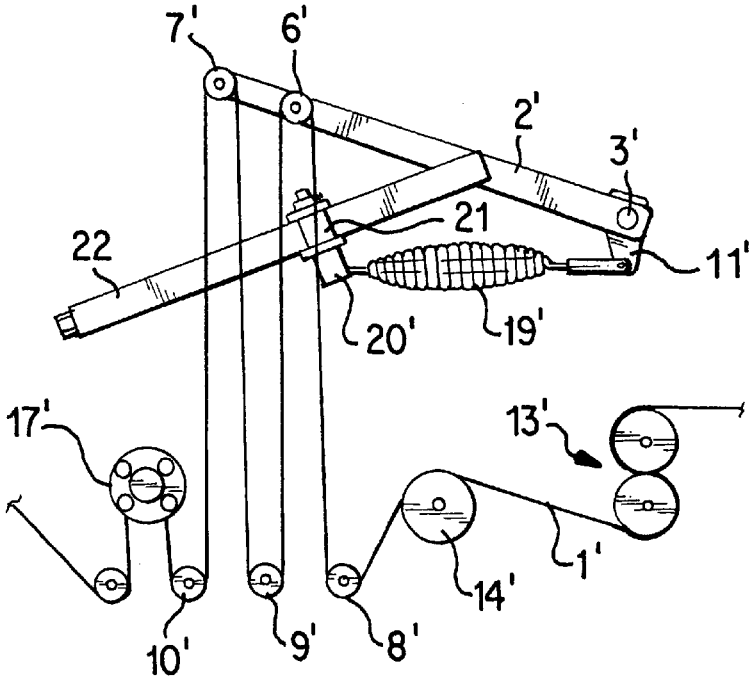
FIG. 3 is a schematic front view of the most significant parts of a unit for controlling or adjusting the tension of an outgoing web of material in accordance with a second embodiment of the invention.

FIG. 3 illustrates a second embodiment of an inventive unit which is generally of the same construction as the unit illustrated in FIG. 2. Those components of the FIG. 2 unit which find correspondence in the unit illustrated in FIG. 1 have been given the same references with the addition of a prime. The sole difference between the two embodiments is that the web tension can be adjusted in the unit shown in FIG. 2. To this end, the attachment means 20' can be moved fixedly to the housing (not shown in FIG. 2) carrying the unit, so that the spring force can be changed by extending or shortening the spring 19'. This movability of the attachment means 20' is achieved by mounting said means on a slide 21 which can be moved along a guide bar 22 and fixed in any desired position along said bar.

As previously mentioned, it has been found that the spring attachment points can be chosen so that web tension will not be influenced by the position to which the dancing arm is rotated. However, this only applies in relation to a given determined web tension. If the spring force is changed, and therewith also the tension in the web, by moving the spring attachment point on the housing, the favourable geometric relationships which in a given load case result in the variation of web tension due to rotation of the dancing arm being practically zero will also change. However, it has been found that even in such a case, the aforesaid web tension variation can be minimized by moving the attachment point in a given path when changing the spring force. It has also been found that this path can be approximated to a straight line. Thus, variations in web tension due to rotation of the dancing arm 2' will be small when operating the unit shown in FIG. 2 with different spring forces and therewith associated different web tensions. The guide bar 22 is inclined so that the attachment means 20' will move both horizontally and vertically in relation to the pivot axle 3' as the slide 21 is moved along the guide bar 22.

As illustrated in FIG. 2, the described units may be placed as close as possible to the process line while being located at a far distance from associated reel stands. Furthermore, the described units are constructed in a manner which enables the units to be given small dimensions, thereby facilitating positioning of the units close to the process line. Because the feed rolls 13 are controlled so that the dancing arm will only perform small pivotal movements in operation, the buffer length of the web 1 which shall be capable of being taken-up by the unit during operation, will also be small. Furthermore, the dancing arm carries two rollers 6, 7 which in the case of the illustrated units means that this buffer length is divided into two loops, which further reduces the need for space in the vertical direction in order to accommodate desired buffer lengths. The described inventive units can therefore be given a very compact construction.

The described exemplifying embodiments may, of course, be modified within the scope of the invention. For instance, the spreader roll 14 can be placed upstream of the feed rolls instead of downstream thereof. The dancing arm may also carry fewer or more web-loop supporting rollers and the position of the units in relation to the conveyors of the process line may be varied. For instance, the units may be placed above or beneath the conveyor instead of on one side thereof. The invention is therefore restricted solely by the content of the following claims.

We claim:

1. A unit for controlling the tension of an outgoing web of material passing through the unit and being delivered to a process line for manufacturing absorbent disposable articles, said unit comprising:

a spring biased dancing arm pivotable about a fixed axle and intended to support a web loop in its free end, wherein a spring force on the dancing arm acts in a direction opposite to the direction of the gravitational force acting on said arm;

a position indicator for continuously sensing a rotational position of the dancing arm and delivering a position signal corresponding to the rotational position;

a pair of feed rolls mounted at an upstream end of the unit, the web passing through the feed rolls when the unit is in operation; and control means for receiving the position signal from the position indicator and adjusting a rotational speed of the pair of feed rolls so that a predetermined tension is maintained in the web going out from the unit.

2. A unit according to claim 1, further comprising a spreader roll mounted downstream of the pair of feed rolls and upstream of the web loop supported by the dancing arm.

3. A unit according to claim 1, wherein the spring force is generated by a pull spring, one end of said pull spring pivotally attached to a lever arm projecting out from the dancing arm at an end of the dancing arm connected to the pivot axle, another end of said pull spring pivotally connected to an attachment means which is attached to a housing for housing the unit components.

4. A unit according to claim 3, wherein the attachment means includes means for moving the attachment means along an inclined path relative to the housing such that when moved, the position of the attachment means in relation to the pivot axle of the dancing arm can be changed both laterally and vertically.

5. A unit according to claim 1, wherein said spring biased dancing arm is pretensioned.

6. A unit according to claim 1, further comprising a smoothing roll mounted downstream of the pair of feed rolls and upstream of the web loop supported by the dancing arm.

7. A unit according to claim 1, wherein said position indicator senses any given rotational position of the dancing arm throughout the range of pivotable movement of the dancing arm.

8. A unit for controlling the tension of an outgoing web of material passing through the unit and being delivered to a process line for manufacturing absorbent disposable articles, said unit comprising:

a spring biased dancing arm pivotable about a fixed axle and intended to support a web loop in its free end, wherein a spring force on the dancing arm acts in a direction opposite to the direction of the gravitational force acting on said arm;

a position indicator for continuously sensing multiple rotational positions of the dancing arm throughout a range of pivotable movement of the dancing arm and delivering a position signal corresponding to the sensed rotational position;

a pair of feed rolls mounted at an upstream end of the unit, the web passing through the feed rolls when the unit is in operation; and control means for receiving the position signal from the position indicator and adjusting a rotational speed of the pair of feed rolls so that a predetermined tension is maintained in the web going out from the unit.

9. A unit according to claim 8, further comprising a spreader roll mounted downstream of the pair of feed rolls and upstream of the web loop supported by the dancing arm.

10. A unit according to claim 8, wherein the spring force is generated by a pull spring, one end of said pull spring pivotally attached to a lever arm projecting out from the dancing arm at an end of the dancing arm connected to the pivot axle, another end of said pull spring pivotally connected to an attachment means which is attached to a housing or the like for housing the unit components.

11. A unit according to claim 10, wherein the attachment means includes means for moving the attachment means along an inclined path relative to the housing such that when moved, the position of the attachment means in relation to the pivot axle of the dancing arm can be changed both laterally and vertically.

12. A unit according to claim 8, wherein said spring biased dancing arm is pretensioned.

13. A unit according to claim 8, further comprising a smoothing roll mounted downstream of the pair of feed rolls and upstream of the web loop supported by the dancing arm.

14. A unit according to claim 8, wherein said control means adjusts the rotational speed of the pair of feed rolls from a first speed to a second speed, said first and second speed greater than zero.

* * * * *